United States Patent [19]

Hefner, Jr.

[11] 4,234,414

[45] Nov. 18, 1980

[54] PHOSPHATE BENEFICIATION PROCESS

[75] Inventor: Robert E. Hefner, Jr., Midland, Mich.

[73] Assignee: The Dow Chemical Company, Midland, Mich.

[21] Appl. No.: 946,487

[22] Filed: Sep. 28, 1978

[51] Int. Cl.[2] ..... B03D 1/02

[52] U.S. Cl. ..... 209/166

[58] Field of Search ..... 209/166; 260/404.5 PA

[56] References Cited

U.S. PATENT DOCUMENTS

| | | | |
|---|---|---|---|
| 2,262,739 | 11/1941 | De Groote | 209/166 X |
| 2,278,060 | 3/1942 | Christmann | 209/166 |
| 2,312,387 | 3/1943 | Christmann | 209/166 |
| 2,514,954 | 7/1950 | Johnson | 260/404.5 PA |
| 2,720,490 | 10/1955 | Oxford | 260/404.5 PA |
| 2,765,325 | 10/1950 | Niederhauser | 260/404.5 PA |
| 2,857,331 | 10/1958 | Hollingsworth | 209/166 X |
| 3,169,980 | 2/1965 | Benoit | 260/404.5 PA |
| 3,260,365 | 7/1966 | Dickson | 209/166 |
| 3,448,048 | 6/1969 | Le Suer | 260/404.5 PA |
| 3,467,684 | 9/1969 | Lane | 260/404.5 PA |
| 3,701,640 | 10/1972 | Lease | 260/404.5 PA |

*Primary Examiner*—Robert Halper

*Attorney, Agent, or Firm*—Michael L. Glenn

[57] ABSTRACT

In the beneficiation of phosphate ore by the flotation of the siliceous material, the utilization of a condensate of a polyethylene polyamine, having from 10 to 24 carbon atoms, with a fatty acid, fatty acid ester or a fatty acid and an alkylolamine improves the separation of phosphate from silica. This improvement is especially great in the presence of unreacted fatty acid. Moreover, this condensate is more readily dispersed in the flotation medium than the condensate of diethylenetriamine with fatty acid employed by the prior art.

7 Claims, No Drawings

PHOSPHATE BENEFICIATION PROCESS

BACKGROUND OF THE INVENTION

This invention relates to an improved process for phosphate beneficiation. In particular, this invention relates to the use of a high molecular weight polyethylene polyamine condensed with a fatty acid, fatty acid ester or with a fatty acid and an alkylolamine in the flotation of siliceous material from phosphate.

In the present commercial beneficiation of siliceous phosphate ores, a deslimed and sized phosphate ore is conditioned with and then floated by a fatty acid collector and fuel oil reagent in an aerated aqueous solution at a pH of at least about 8. This flotation process produces a low-grade phosphate concentrate containing from about 50 to 65 weight percent bone phosphate of lime (BPL). The "rougher float concentrate" from the aforementioned flotation is blunged with acid to remove fatty acid collector coatings and the phosphate is further concentrated by flotation of residual silica from the concentrate with a so-called cationic amine collector.

U.S. Pat. No. 2,278,060 teaches that the reaction product of a polyalkylene polyamine with a fatty acid, a fatty acid glyceride or other fatty acid esters, as well as their corresponding water-soluble salts, can be used as cationic amine collectors. U.S. Pat. No. 2,278,107; 2,312,387; 2,322,201; and 2,710,856 also disclose the use of reaction products of a polyalkylene polyamine with a fatty acid, alone or in combination with other flotation agents, to effect the flotation of silica from phosphate. However, the above-identified references explicitly disclose polyethylene polyamines having only 8 or fewer carbon atoms in the reaction with the fatty acid. The polyethylene polyamines having a molecular weight less than 200 grams per mole, in particular diethylenetriamine, condensed with a fatty acid are currently the cationic amine collectors of choice.

The above-described cationic amine collectors are effective in the recovery of BPL from phosphate ore, but the condensates of lower molecular weight polyethylene polyamines suffer from a number of deficiencies. U.S. Pat. No. 3,640,862 discloses that these cationic amine collectors are viscous pastes which are difficult to disperse in water. Further, the effectiveness of these collectors is severely diminished in the presence of residual fatty acid collector coatings from a first flotation step. Residual fatty acid, present in as litte as 0.01 kilogram per ton of feed, has an adverse impact on the selectivity of the prior art collector. U.S. Pat. No. 2,710,856 teaches that unsubstituted polyalkylene polyamines react incompletely with the rosin acids contained in tall oil, which results in an amine collector of inferior selectivity. Finally, the demand for diethylenetriamine in alternative, less cost-sensitive uses has resulted in a steady escalation in the price of diethylenetriamine. This increasing price has spurred a search in the phosphate industry for a flotation agent possessing greater cost-effectiveness, which does not possess the deficiencies of the prior art collectors.

SUMMARY OF THE INVENTION

According to this invention, a process for beneficiating a siliceous phosphate ore by froth flotation with a collector for the flotation of siliceous matter is improved wherein the collector system comprises an enhancing amount of a condensate or an acid salt of a condensate of a polyethylene polyamine corresponding to the formula $$H_2N\text{-}(C_2H_4NH)_x\text{-}C_2H_4\text{-}NH_2$$

wherein x is an integer of 4 to 11, with a fatty acid, fatty acid ester or fatty acid and an alkanolamine.

DETAILED DESCRIPTION OF THE INVENTION

The polyethylene polyamine utilized as a component of the condensate in the practice of this invention is a pentaethylenehexamine, hexaethyleneheptamine, heptaethyleneoctamine, octaethylenenonamine, nonaethylenedecamine, higher polyethylene polyamines in this series or a mixture of the foregoing compounds. The polyethylene polyamines can operably bear one or more tertiary amines producing a branched or cyclic isomer (such as a substituted piperazine). However, it is preferred that the polyethylene polyamine contain a predominant amount of straight-chained isomers. The polyethylene polyamine condensed with the fatty acid or fatty acid ester can operably be a component of a mixture of polyethylene polyamines of both lower and higher molecular weight than those having 10 to 24 carbon atoms described above. However, it is preferred that the polyethylene polyamine comprise at least about 20 weight percent, more preferably at least about 50 weight percent, most preferably at least about 80 weight percent, of polyethylene polyamines having 10 to 24 carbon atoms.

The polyethylene polyamines can be produced by conventional manners known to the art. One favored method of preparation is to heat ethylene chloride with ammonia under pressure at a temperature of about 80° C. to 120° C. to produce a mixture of polyethylene polyamines with ethylenediamine. The lower molecular weight components can be readily removed by distillation to leave a crude mixture of higher polyethylene polyamines. The desired higher molecular weight polyamines can be produced in good yield by recycling the lower molecular weight polyamine products to the ethylene chloride/ammonia reaction. The use of the crude mixture of higher polyethylene polyamines so prepared is preferred, because it is relatively inexpensive.

The fatty acid condensed with the polyethylene polyamine can be a saturated or an unsaturated acid. The fatty acid can suitably bear hydroxyl substituents on its alkyl portion, but such substitution does not impart any substantial advantage. Fatty acids such as oleic, lauric, linoleic, palmitic, stearic, myristic, mixtures thereof and other like fatty acids are operable. The esters corresponding to the fatty acids, such as glycerides, are also operable, but less preferred. For reasons of economy, it is preferred to use crude mixtures of fatty acids, rosin acids, lignin, and unsaponifiable matter derived from vegetable or animal sources, such as tall oil, coconut oil, palm oil, palm kernel oil, cottonseed oil, linseed oil, olive oil, peanut oil, fish oil and the like. Tall oil is an especially preferred mixture of fatty acids and rosin acids, which unexpectedly reacts substantially completely with the higher polyethylene polyamines.

The fatty acid or a corresponding ester and the polyethylene polyamine can be readily reacted by bringing these reactants together and heating until the desired degree of condensation has taken place. Generally, a reaction temperature of from about 130° C. to 250° C. is operable. The reaction is termed a condensation herein to distinguish it from the formation of the ammonium salt of the acid at lower temperatures. Although it is desirable that the condensation reaction is substantially complete, the condensate is effective as a cationic amine collector even in the presence of a substantial amount of the ammonium salt of the acid. The fatty acid or ester and polyethylene polyamine can operably, but less preferably, be reacted in the presence of other reactive compounds (such as alkanolamines, like triethanolamine) to form a complex mixture of the polyethylene polyamine-fatty acid collector with other collectors.

The efficacy of the instant collector is greatest when the reactants are condensed in a specific range of mole ratios. The mole ratio of polyethylene polyamine to the total of fatty acid, fatty acid ester and alkylolamine should be less than about 1:4, preferably in the range from about 1:2 to about 1:3. Advantageously, at least about a stoichiometric amount of the fatty acid and fatty acid ester is reacted with the polyamine, but a less than stoichiometric amount is operable if greater loading of the collector is employed to offset dilution by unreacted polyamines.

The product of the condensation, particularly those products of polyethylene polyamines having 10 to 18 carbon atoms, is more readily dispersed or dissolved in an aqueous medium than are the prior art collectors. The condensation product can then be used directly as a cationic amine collector. Alternatively, the condensation product can be combined with a mineral or carboxylic acid, such as formic, acetic, hydrochloric and like acids, and used in the form of its acid salt.

The collector system can comprise the cationic amine collector of the present invention utilized alone or a mixture of this collector with other cationic amine collectors. In particular, this collector can be used in conjunction with conventional diethylene triamine/tall oil flotation agents to improve the free fatty acid tolerance, dispersibility and/or selectivity of the collector system. The term "enhancing amount" is used herein to denote the amount of the instant condensate required to impart one or more of the above-identified improved properties to the collector system. The collector can likewise be used in conjunction with other adjuvants such as activators, conditioning reagents, dispersing reagents, frothing reagents and depressing reagents.

The practice of the method of this invention can be used alone to beneficiate siliceous phosphate ore after washing, desliming and sizing the ore. However, this collector is more preferably used to beneficiate a so-called "rougher float concentrate", which is obtained by the flotation of the phosphate values in the ore with a fatty acid followed by an acid washing of the collected phosphate to remove the residual fatty acid coating. Desirably, the phosphate is from the so-called Florida phosphate ore, which is substantially free of carbonate impurities after washing and sizing. Generally, a phosphate rougher concentrate in the size range from plus 200 mesh to minus 1 millimeter is amenable to beneficiation by the disclosed process.

The flotation collector, as previously described, can be used in the separation of siliceous matter from phosphate values in a manner like that known in the art for other cationic amine collectors. The flotation feed is deslimed and treated with mineral acid to remove residual fatty acid collector coatings, if necessary. The collector and other flotation reagents are then introduced into an aqueous pulp of the phosphate feed at a density suitable for flotation. The feed can be briefly conditioned with the collector, or, less preferably, aerated without conditioning to float the siliceous matter. The concentrated phosphate rock is then recovered in the underflow.

The optimum loading of the higher polyethylene polyamine condensate to produce best separation and greatest recovery of the phosphate values is influenced by the relative concentration of phosphate and insolubles (such as sand) in the flotation feed, the use of other collectors, the type of ore bodies, the loading of other flotation adjuvants (for example, fuel oil) and other factors. Generally, if the polyamine condensate is the only collector employed, a ratio of from about 0.05 to about 1 kilogram of condensate per ton of flotation feed is desirable. The use of the disclosed collector at the above-described loadings reduces or obviates the need for frothers, such as pine oil, in the flotation medium.

It is generally advantageous to employ fuel oil in the medium as an adjuvant to the collector. Representative fuel oils include diesel oil, kerosene, Bunker C fuel oil, mixtures thereof and the like. The fuel oil can operably be employed in any ratio less than about 1 kilogram of fuel oil per ton of flotation feed. Preferably, the fuel oil is present in a ratio of at least about 0.05 kilogram of fuel oil per ton of flotation feed.

The following examples are illustrative embodiments of this invention. Unless otherwise indicated all parts and percentages are by weight.

EXAMPLE 1

In a series of identical runs that differ only in the loading and identity of the collector employed, a 500 gram charge of phosphate rougher float concentrate washed with a mineral acid and water is beneficiated by froth flotation. The rougher float concentrate is derived from phosphate ore mined near Fort Meade, Fla. The above-described concentrate is found by conventional methods of analysis to contain 61.9 percent of BPL. The feed is first diluted with water to obtain a slurry with a pulp density of about 20 percent solids. This slurry is transferred to a Denver flotation machine, where it is combined with a collector.

The collector is prepared by reacting a tall oil fatty acid with a polyethylene polyamine at a temperature from about 130° C. to about 225° C. until the reaction is substantially complete (about 2.5 hours). Substantial completion of the reaction is determined by monitoring the water by-product from the reaction and by infrared analysis. The composition of the tall oil fatty acid (TOFA) is 39 percent rosin acids, 29.3 percent oleic acid, 23 percent linoleic acid, 3.7 percent conjugated linoleic acid, 1.8 percent stearic acid and about 5 percent other fatty acids and components. The composition of this polyethylene polyamine (PEPA) is less than 0.1 percent triethylenetetramine, 8 percent tetraethylenepentamine, and a remaining amount of polyethylene polyamines having at least 10 carbon atoms. The average molecular weight of the PEPA is 295 grams per mole. A condensate of tall oil fatty acid with even higher polyethylene polyamines (HPEPA), said polyamines having an average molecular weight of about 320 grams per mole and less than 1 percent tetraethylene pentamines or lower polyamines, is also used as a collector. The mole ratio of the polyamine to the tail oil is either 1:1, 1:2 or 1:3. The above-described condensates are neutralized with acetic acid to a pH of about 7 and utilized as collectors in the form of these acetate salts.

A diethylenetriamine condensate with tall oil (DETA/TOFA), not embodied in this invention, is also employed in some runs to provide a basis for comparison with the prior art. This DETA/TOFA collector is obtained commercially from Westvaco Corporation. The DETA/TOFA collector is an acetate salt of a condensate of DETA and TOFA having a pH of about 6.5 and a mole ratio of DETA to TOFA of about 1:2.

All of the above-identified collectors are introduced into the flotation slurry in 0.125, 0.15, 0.175 and 0.2 gram charges, which readily dissolve. An amount of fuel oil #2 equal in weight to the charge of collector is also introduced into the slurry. The phosphate rougher float concentrate is then briefly conditioned with the collector and fuel oil by high speed agitation of the medium. Flotation is promoted by aeration with mixing for two to three minutes, during which the floating concentrate is collected.

The concentrate collected and the tail material are individually dewatered by 150 mesh screen and dried. Both the concentrate and tail fractions are analyzed for percent BPL by standard photometric methods against a water reference.

In Table I is tabulated the mole ratio of the components condensed, the loading of the collector in kilograms per metric ton of phosphate feed and the BPL assay of the tail and concentrate. The weight distribution of phosphate in each of these fractions is also normalized and tabulated as a percentage of the total phosphate to provide indices of the degree of separation effected.

TABLE I

| Run | Condensate | Ratio (polyamine:TOFA) | Loading (kg/ton) | Concentrate (% BPL) | Tail (% BPL) | Normalized Distribution % Concentrate | Normalized Distribution % Tail |
|---|---|---|---|---|---|---|---|
| 1A | PEPA:TOFA | 1:1 | 0.4 | 21.0 | 73.4 | 8.4 | 91.6 |
| 1B | " | " | 0.35 | 16.0 | 73.4 | 5.5 | 94.5 |
| 1C | " | " | 0.3 | 10.9 | 73.3 | 3.2 | 96.8 |
| 1D | " | " | 0.25 | 5.5 | 71.9 | 1.3 | 98.7 |
| 2A | PEPA:TOFA | 1:2 | 0.4 | 15.1 | 73.7 | 5.4 | 94.6 |
| 2B | " | " | 0.35 | 11.6 | 73.7 | 3.7 | 96.3 |
| 2C | " | " | 0.3 | 9.0 | 73.3 | 2.7 | 97.3 |
| 2D | " | " | 0.25 | 6.8 | 72.6 | 1.8 | 98.2 |
| 3A | PEPA:TOFA | 1:3 | 0.4 | 7.9 | 74.3 | 2.3 | 97.7 |
| 3B | " | " | 0.35 | 7.4 | 74.9 | 2.1 | 97.9 |
| 3C | " | " | 0.3 | 5.0 | 73.4 | 1.3 | 98.7 |
| 3D | " | " | 0.25 | 4.6 | 73.3 | 1.1 | 98.9 |
| 4A | HPEPA:TOFA | 1:2 | 0.4 | 9.6 | 73.1 | 3.0 | 97.0 |
| 4B | " | " | 0.35 | 8.2 | 74.7 | 2.5 | 97.5 |
| 4C | " | " | 0.3 | 6.0 | 73.3 | 1.7 | 98.3 |
| 4D | " | " | 0.25 | 4.6 | 72.5 | 1.1 | 98.9 |
| 5A* | DETA:TOFA | 1:2 | 0.4 | 7.4 | 72.0 | 2.0 | 98.0 |
| 5B* | " | " | 0.35 | 5.6 | 71.8 | 1.4 | 98.6 |
| 5C* | " | " | 0.3 | 4.4 | 70.5 | 0.9 | 99.1 |
| 5D* | " | " | 0.25 | 3.5 | 69.0 | 0.6 | 99.4 |

*DETA/TOFA Condensate; not an embodiment of this invention.

The data in Table I demonstrates that at all loadings of collectors the polyethylene polyamine condensates effect a significantly higher assay of phosphate in the tail than does the DETA condensate. This improvement is valuable because the market price of phosphate is directly related to its assay, with a premium being paid for assays greater than 72 BPL. This enhanced assay is effected at the sacrifice of only a minor decrease in total phosphate recovery relative to the DETA condensates.

EXAMPLE 2

A series of identical runs, that differ only in the loading and identity of the collector employed, are performed in the same manner as in Example 1 with minor differences disclosed hereinafter. A 500 gram charge of phosphate rougher float concentrate is partially washed with a mineral acid and water. Such incomplete washing of the phosphate occurs occasionally in commercial practice and results in the presence of a substantial amount of residual tall oil fatty acid in the feed. The above-described feed is found by conventional methods of analysis to contain 45.6 percent of BPL. The feed is dispersed in water effecting a pulp density of about 20 percent solids and then is conditioned in separate runs with the DETA/TOFA, HPEPA/TOFA and PEPA/-TOFA collectors described in Example 1. All of the above-identified collectors are employed in the form of an acetate salt with an equivalent weight amount of #2 fuel oil.

Flotation is initiated by aeration with mixing in a Denver flotation machine for two to three minutes. The floating concentrate is collected and the concentrate and tail material are individually dewatered by 150 mesh screen and dried. Both the concentrate and tail fractions are analyzed for percent BPL by standard photometric methods.

In Table II is tabulated the mole ratio of the components condensed, the loading of the collector in kilograms per metric ton of phosphate feed and the BPL assay of the tail and concentrate. The weight distribution of phosphate in each of these fractions is also normalized and tabulated as a percentage of the total phosphate to provide indices of the degree of separation effected.

TABLE III

| Run | Condensate | Ratio (polyamine:TOFA) | Loading (kg/ton) | Concentrate (% BPL) | Tail (% BPL) | Normalized Distribution % Concentrate | Normalized Distribution % Tail |
|---|---|---|---|---|---|---|---|
| 1A | PEPA/TOFA | 1:1 | 0.3 | 4.2 | 70.8 | 3.8 | 96.2 |
| 1B | " | " | 0.4 | 6.9 | 70.7 | 6.9 | 93.1 |
| 2A | PEPA/TOFA | 1:2 | 0.3 | 2.9 | 71.7 | 2.6 | 97.4 |

TABLE III-continued

| Run | Condensate | Ratio (poly-amine:TOFA) | Loading (kg/ton) | Concentrate (% BPL) | Tail (% BPL) | Normalized Distribution % Concentrate | % Tail |
|---|---|---|---|---|---|---|---|
| 2B | " | " | 0.4 | 5.6 | 73.1 | 4.6 | 95.4 |
| 3A | HPEPA/TOFA | 1:2 | 0.3 | 2.6 | 69.7 | 2.2 | 97.8 |
| 3B | " | " | 0.4 | 2.9 | 70.9 | 2.5 | 97.5 |
| 4A* | DETA/TOFA | 1:2 | 0.3 | 2.0 | 59.3 | 1.0 | 99.0 |
| 4B* | " | " | 0.4 | 2.3 | 65.9 | 1.6 | 98.4 |

*Not an embodiment of this invention.

The data in Table II demonstrates at both loadings of the collector the higher polyethylene polyamine condensates effect with fatty acid contaminated feed a significantly higher assay of phosphate in the underflow than does the DETA condensate. The enhanced assay is effected with only a minor decrease in phosphate recovery compared to the standard DETA condensate. Collector fatty acid tolerance is particularly enhanced with tall oil fatty acid condensed in a 2:1 mole ratio with the polyethylene polyamines having an average molecular weight of 295 grams per mole.

EXAMPLE 3

A series of identical runs, that differ only in the loading and identity of the collector employed, are performed in the same manner as in Example 1 with minor differences disclosed hereinafter. A 500 gram charge of phosphate rougher float concentrate that has been washed with mineral acid and water is beneficiated by froth flotation. The rougher float concentrate is derived from phosphate ore mined near Fort Meade, Fla. The size distribution in this rougher float concentrate is determined by separating it with screens. Nearly 50 percent of the concentrate is distributed in the range from minus 35 mesh to plus 65 mesh. Only 3.9 and 1.7 percent of the concentrate, respectively, is larger than 28 mesh or smaller than 150 mesh. This rougher float concentrate is found by conventional methods of analysis to contain 60.7 percent of BPL and 18.7 percent acid-insoluble material. The concentrate is transferred to a Denver flotation machine as a slurry of suitable density, where it is combined with a collector and an equal weight of #2 fuel oil. During aeration of the medium for two to three minutes, the floating concentrate is collected. The concentrate and tail material are individually dewatered, dried and analyzed for percent BPL.

The collector is prepared in the manner described in Example 1 from polyethylene polyamine (PEPA), except that tall oil fatty acid heads (HTOFA) are condensed with the polyamines. The HTOFA contains 54 percent palmitic acid, 20.3 percent oleic acid, 12.6 percent linoleic acid, 1 percent rosin acids, and about 12 percent of other fatty acids and components. The condensates are prepared with a molar ratio of 1:2 or 1:3 of the polyamines to the HTOFA. In one set of runs the condensation reaction is terminated before it is substantially complete and a substantial, but minor amount of an ammonium salt of the fatty acid is present with the condensate. The condensates are utilized in the form of neutralized acetate salts.

A standard diethylenetriamine condensate with TOFA described in Example 1 is also employed in one series of runs. This condensate is not an embodiment of the invention, but instead illustrates the efficacy of the prior art condensates.

In Table III is tabulated the mole ratio of the components condensed, whether or not the collector is utilized as an acetate salt, the loading of the collector (including any ammonium salt of the fatty acid) in kilograms per metric ton of phosphate feed and the BPL assay of the tail and concentrate. The weight distribution of phosphate in each of these fractions is also normalized and tabulated as a percentage of the total phosphate to provide indices of the degree of separation effected. Finally, the percent acid-insoluble material in the tail is tabulated.

TABLE III

| Run | Condensate | Acid-Insoluble (%) | Ratio (poly-Amine:HTOFA) | Loading (kg/ton) | Concentrate (% BPL) | Tail (% BPL) | Normalized Distribution % Concentrate | % Tail |
|---|---|---|---|---|---|---|---|---|
| 1A | PEPA/HTOFA | not available | 1:2 | 0.25 | 5.7 | 72.9 | 1.2 | 98.8 |
| 1B | " | " | " | 0.3 | 8.1 | 74.3 | 2.1 | 97.9 |
| 1C | " | " | " | 0.35 | 10.9 | 75.1 | 3.2 | 96.8 |
| 1D | " | " | " | 0.4 | 15.3 | 75.1 | 5.1 | 94.9 |
| 2A | PEPA/HTOFA | 4.6 | 1:3 | 0.15 | 9.3 | 72.9 | 2.3 | 97.7 |
| 2B | " | 3.5 | " | 0.25 | 32.0 | 73.5 | 13.1 | 86.9 |
| 2C | " | 3.0 | " | 0.3 | 34.1 | 73.7 | 15.3 | 84.7 |
| 2D | " | 3.3 | " | 0.4 | 45.3 | 73.3 | 29.4 | 70.6 |
| 3A | PEPA/HTOFA** | 5.5 | 1:3 | 0.25 | 6.1 | 71.3 | 1.4 | 98.6 |
| 3B | " | 3.9 | " | 0.3 | 9.1 | 72.3 | 2.3 | 97.7 |
| 3C | " | 3.3 | " | 0.35 | 12.8 | 73.1 | 3.6 | 96.4 |
| 3D | " | 3.3 | " | 0.4 | 22.2 | 73.3 | 7.9 | 92.1 |
| 4A* | DETA/TOFA | 9.3 | 1:2 | 0.15 | 3.9 | 68.8 | 0.7 | 99.3 |
| 4B* | " | 6.2 | " | 0.25 | 6.0 | 71.3 | 1.3 | 98.7 |
| 4C* | " | 4.8 | " | 0.35 | 7.5 | 72.1 | 1.7 | 98.2 |
| 4D* | " | 4.7 | " | 0.4 | 12.4 | 72.7 | 3.5 | 96.5 |

*Not an embodiment of this invention.
**Contains substantial amount of ammonium salt of fatty acid.

The data in Table III demonstrates that the improved phosphate assay effected by the polyethylene polyamine condensate is not dependent on a particular fatty acid reactant (such as the one employed in Example 1). The improvement is especially pronounced in runs 2A–2D in which the collector is so effective that reduced loadings must be employed to avoid flotation of phosphate values. The data also demonstrates that the disclosed collector reduced the amount of undesirable acid-insoluble material in the tail.

EXAMPLE 4

A series of identical flotation runs are made that differ only in the loading and identity of the collector employed. These runs are performed in the manner described in Example 1, except that the phosphate charge is prepared from phosphate ore from the Fort Green Mine in Florida. The ore has been beneficiated in a rougher float, and then washed with mineral acid and water, prior to flotation with the instant condensate. The concentrate is then transferred to a Denver flotation machine in an aqueous slurry of suitable density, where it is combined with a collector. Unlike Example 1, no fuel oil is employed with the collector. The medium is aerated for two or three minutes and the concentrate and tail material are individually dewatered, dried and analyzed for percent BPL.

The collector is prepared in the same manner as described in Example 1 from TOFA condensed with PEPA or HPEPA. These condensates are prepared with a molar ratio of 1:1 or 1:2 of the polyamine to the TOFA. These condensates are employed in the form of their acetate salts at loadings of 0.1 kilogram per ton of feed. A prior art DETA/TOFA collector, obtained commercially from Westvaco Corporation, is also employed in one of the runs.

In Table IV is tabulated the mole ratio of the components condensed, the loading of the collector in kilograms per metric ton of phosphate feed and the BPL assay of the tail and concentrate. The weight distribution of phosphate in each of these fractions is also normalized and tabulated as a percentage of the total phosphate to provide indices of the degree of separation effected.

TABLE IV

| Run | Condensate | Ratio (polyamine:TOFA) | Concentrate (% BPL) | Tail (% BPL) | Normalized Distribution % Concentrate | % Tail |
|---|---|---|---|---|---|---|
| 1 | PEPA/TOFA | 1:1 | 24.81 | 73.36 | 5.92 | 94.08 |
| 2 | PEPA/TOFA | 1:2 | 21.51 | 74.47 | 4.31 | 95.69 |
| 3 | HPEPA/TOFA | 1:1 | 12.98 | 74.08 | 2.50 | 97.50 |
| 4* | DETA/TOFA | 1:2 | 23.02 | 73.72 | 5.66 | 94.34 |

*Not an embodiment of this invention.

The data in Table IV demonstrates that with some phosphate ore bodies, the claimed collectors effect both improved phosphate recovery and higher phosphate product assays than does the prior art DETA/TOFA condensate.

What is claimed is:

1. In a process for beneficiating a siliceous phosphate ore by froth flotation with a collector system for the flotation of siliceous matter, wherein fuel oil is present during flotation as an adjuvant to the collector, the improvement wherein the collector system comprises an enhancing amount of a condensate or an acid salt of a condensate of a polyethylene polyamine corresponding to the formula $$H_2N\text{-}(C_2H_4NH)_x\text{-}C_2H_4\text{-}NH_2$$

wherein x is an integer of 4 to 11, with a tall oil fatty acid or tall oil fatty acid ester.

2. The process as described in claim 1, wherein the condensate is utilized in the form of its acid salt.

3. The process as described in claim 1, wherein x is an integer of 4 to 8.

4. The process as described in claim 1, wherein the polyethylene polyamine is condensed with the fatty acid or fatty acid ester in a molar ratio of from about 1:1 to about 1:4.

5. The process as described in claim 1, wherein the siliceous phosphate ore is contaminated with residual amounts of free fatty acid.

6. The process as described in claim 1, wherein the collector system consists essentially of condensates of tall oil fatty acid or tall oil fatty acid ester with polyethylene polyamines wherein x is an integer of 4 to 11 for at least 20 weight percent of said polyethylene polyamines.

7. In a process for beneficiating a siliceous phosphate ore by froth flotation with a collector system for the flotation of siliceous matter, the improvement wherein the collector system comprises an enhancing amount of a condensate or an acid salt of a condensate of a polyethylene polyamine corresponding to the formula $$H_2N\text{-}(C_2H_4NH)_x\text{-}C_2H_4\text{-}NH_2$$

wherein x is an integer of 4 to 11, with a tall oil fatty acid or a tall oil fatty acid ester, wherein the polyethylene polyamine is condensed with the tall oil fatty acid or tall oil fatty ester in a molar ratio of from about 1:2 to about 1:3.

* * * * *